US009657238B2

(12) United States Patent
Abudawoud et al.

(10) Patent No.: US 9,657,238 B2
(45) Date of Patent: May 23, 2017

(54) PROCESS FOR PRODUCING AROMATICS FROM WIDE-BOILING TEMPERATURE HYDROCARBON FEEDSTOCKS

(71) Applicant: Saudi Arabian Oil Company, Dhahran (SA)

(72) Inventors: Raed Abudawoud, Dhahran (SA); Mohammed Al-Amer, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 53 days.

(21) Appl. No.: 14/872,971

(22) Filed: Oct. 1, 2015

(65) Prior Publication Data

US 2016/0097008 A1 Apr. 7, 2016

Related U.S. Application Data

(60) Provisional application No. 62/059,249, filed on Oct. 3, 2014, provisional application No. 62/121,200, filed on Feb. 26, 2015.

(51) Int. Cl.

| | |
|---|---|
| ***C10G 69/02*** | (2006.01) |
| ***C10G 59/02*** | (2006.01) |
| ***C10G 63/02*** | (2006.01) |
| ***C10G 69/08*** | (2006.01) |
| ***C10G 69/10*** | (2006.01) |

(52) U.S. Cl.

CPC ..... *C10G 69/02* (2013.01); *C10G 59/02* (2013.01); *C10G 63/02* (2013.01); *C10G 69/08* (2013.01); *C10G 69/10* (2013.01); *C10G 2400/30* (2013.01)

(58) Field of Classification Search

CPC .... C10G 2400/30; C10G 59/02; C10G 63/02; C10G 69/02; C10G 69/08; C10G 69/10; C10G 2400/02; C10G 45/00; C10G 47/16; C10G 47/20; C10G 65/00; C10G 65/14; B01J 27/12; C07C 15/08; C10L 1/06

See application file for complete search history.

(56) References Cited

U.S. PATENT DOCUMENTS

| | | | |
|---|---|---|---|
| 4,246,094 | A | 1/1981 | McCaulay et al. |
| 5,993,643 | A | 11/1999 | Chang et al. |
| 6,342,152 | B1 | 1/2002 | Yoshita |
| 6,515,032 | B2 | 2/2003 | Moore, Jr. et al. |
| 7,462,276 | B2 | 12/2008 | Wang et al. |
| 2005/0252830 | A1 | 11/2005 | Treesh et al. |

FOREIGN PATENT DOCUMENTS

| | | | |
|---|---|---|---|
| EP | 2149594 | A1 | 2/2010 |
| WO | 9422982 | | 10/1994 |
| WO | 9836037 | | 8/1998 |
| WO | 02081598 | A1 | 10/2002 |
| WO | 2008092232 | A1 | 8/2008 |

OTHER PUBLICATIONS

International Search Report and Written Opinion for related PCT application PCT/US2015/053412 dated Feb. 11, 2016.

*Primary Examiner* — Sharon Pregler

(74) *Attorney, Agent, or Firm* — Bracewell LLP; Constance Gall Rhebergen

(57) ABSTRACT

The present invention relates to methods and systems useful for producing aromatics-rich products from liquid hydrocarbon condensates. The production system includes a hydroprocessing reactor, an aromatization reactor system and a hydrogen extraction unit. The methods for producing the aromatics-rich products include introducing a wide boiling range condensate into the hydroprocessing reactor and operating the aromatics production system such that the hydroprocessing reactor forms a naphtha boiling temperature range liquid product. The liquid hydrocarbons produced in accordance with the present invention may optionally be further processed using a hydrogen extraction unit to produce a high-purity hydrogen fraction.

14 Claims, 2 Drawing Sheets

PROCESS FOR PRODUCING AROMATICS FROM WIDE-BOILING TEMPERATURE HYDROCARBON FEEDSTOCKS

BACKGROUND OF THE INVENTION

1. Field of the Invention

The present invention relates to the production of commercially valuable aromatic chemicals. More specifically, the field relates to methods and processes for producing aromatic chemicals such as benzene, toluene and the xylenes (BTEX) from wide-boiling temperature range hydrocarbon feedstocks.

2. Description of the Related Art

The efficient and economic production of hydrocarbon based fuels and commodity chemicals is critically important to global markets and commerce. The unrefined, "wide-boiling" temperature range hydrocarbon fractions derived from subterranean reservoirs such as natural gases, light hydrocarbon condensates, natural gas liquids, shale gases and light-gravity crude oils are used to produce light petroleum liquids, typically in the propyl ($C_3$) to dodecyl ($C_{12}$) hydrocarbon range, via well-known fractionation and distillation processes. In some instances, these processes are comparable to methods using one or more atmospheric, pressure crude separations towers for fractionating traditional crude oil. The fractionated products include liquefied petroleum gas (LPG), natural gasoline, naphtha, and atmospheric gas oil fractions. The resulting products may be commercialized or further processed for the reduction or removal of various impurities found within each boiling fraction to produce refined fuels and hydrocarbon based chemicals such as gasolines, kerosene, diesel fuels, fuel enhancing and stabilizing additives and olefins including ethylene and propylene.

Wide-boiling temperature range hydrocarbons are also useful in the production of light olefins, particularly in the ethyl ($C_2$) to butyl ($C_4$) hydrocarbon range, using steam-cracking reformation or pyrolysis furnace based processes to "crack" the heavy hydrocarbon material into light olefins, commercial polymer subunits and related derivative chemicals.

However, the processing of wide-boiling temperature range hydrocarbon typically results in contamination from sulfurous and nitrogenous compounds as well as heterorganic species. These undesirable contaminants, as well as adventitious metals such as copper, iron, nickel, vanadium and sodium, need to be efficiently removed or reduced from hydrocarbon fractions that ultimately give rise to commercial fuels and commodity chemicals. It is therefore desirable to process wide-boiling temperature range hydrocarbon fractions with minimal treatment for conversion into useful petrochemicals such as aromatic commodity chemicals including benzene, toluene and the xylenes (BTEX). While wide boiling range condensates are considered "alternative" feedstocks that are developed globally from tight-gas formations, BTEX chemicals and their derivatives are less reactive. These valuable chemicals have a global marketplace that is not limited to local use unlike, e.g. light olefins, which are highly reactive and therefore expensive to handle and transport. It is also desirable to reduce or eliminate the necessity for separating wide-boiling temperature range hydrocarbons into fractional components prior to processing and refining as well as reducing the presence of undesirable contaminants such as sulfur, metals and compounds containing the same.

SUMMARY OF THE INVENTION

The present invention relates to a method for producing hydrocarbon products from a wide boiling range condensate comprising the steps of: introducing the wide boiling range condensate and hydrogen into a hydroprocessing reactor of an aromatics production system, where a volume ratio of the hydrogen to the wide boiling range condensate introduced is in a range of from about 0.01 to about 10; operating the aromatics production system under conditions such that the hydroprocessing reactor forms both a light product gas mixture and a naphtha boiling temperature range liquid product, where the naphtha boiling temperature range liquid product consists of naphtha boiling temperature range liquid product components having boiling point temperatures in a range of about 30° C. to about 240° C.; passing the naphtha boiling temperature range liquid product to an aromatization reactor system and the light product gas mixture passes to a hydrogen extraction unit; operating the aromatization reactor system under conditions appropriate for forming one or more hydrocarbon products; passing the hydrogen to the hydrogen extraction unit and at least a portion of the non-aromatic liquid product to the aromatization reactor system; producing hydrogen and a mixed hydrogen-poor gas in the hydrogen extraction unit, wherein the mixed hydrogen-poor gas comprises no less than 70% by weight $C_1$ to $C_5$ alkanes; and passing the hydrogen to the hydroprocessing reactor.

In preferred embodiments, the hydrocarbon products are selected from the group consisting of aromatic hydrocarbons, petrochemicals, gasolines, kerosene, diesel fuels, liquefied petroleum products, fuel enhancing hydrocarbons, fuel stabilizing hydrocarbons and olefins. In further embodiments, the hydrogen comprises high-purity hydrogen. In still further embodiments, the aromatization reactor system produces one or more hydrocarbon products selected from an aromatics-rich system product, a hydrogen-rich gas product, a non-aromatic liquid product. In certain embodiments, the non-aromatic liquid product comprises C9+ paraffins, naphthenes and monocyclic aromatic compounds, which are aromatic compounds comprising one benzene based ring. In some embodiments, the hydroprocessing reactor further comprises a hydroprocessing catalyst in a hydrogen atmosphere. In certain embodiments, the hydroprocessing catalyst is operable to reduce the concentration of non-hydrocarbon compounds selected from sulfur, nitrogen, transition metals, alkali metals and alkaline earth metals.

In further embodiments, the hydrogen extraction unit further comprises a solvent extraction system. In still further embodiments, a portion of the wide boiling range condensate has a true boiling point (TBP) temperature greater than about 230° C. In some embodiments, the wide boiling range condensate is converted into the naphtha boiling temperature range liquid product at an initial conversion rate in a range of from about 15% to about 75%. In certain embodiments, the wide boiling range condensate has a final boiling point (FBP) temperature in a range of from about 400° C. to about 600° C. In some embodiments, the wide boiling range condensate comprises aromatics in a range of about 0.1% by weight to about 40% by weight of the wide boiling range condensate. In certain embodiments, the aromatic hydrocarbons comprise mixed xylenes in a range of from about 8% by weight to about 30% by weight.

In some embodiments, the volume ratio of the hydrogen fraction to the wide boiling range condensate fraction that is introduced into the hydroprocessing reactor is in a range of from about 0.01 to about 10. The hydrogen fraction comprises both "make-up" hydrogen as well as high-purity hydrogen produced. In some embodiment, the "make-up" hydrogen portion of the hydrogen fraction is produced by a regulator controlled or continuous flow hydrogen line. In some embodiments, the high-purity hydrogen portion of the hydrogen fraction is produced in a recycle stream.

BRIEF DESCRIPTION OF THE DRAWINGS

So that the manner in which the features, advantages and compositions of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments. The present technology will be better understood on reading the following detailed description of non-limiting embodiments thereof, and on examining the accompanying drawings, in which.

DETAILED DESCRIPTION OF THE INVENTION

Although the following detailed description contains specific details for illustrative purposes, the skilled artisan will appreciate that many examples, variations and alterations to the following details are within the scope and spirit of the invention. Accordingly, the exemplary embodiments of the invention described herein and provided in the appended figures are set forth without any loss of generality, and without undue limitations, on the claimed invention. The referenced elements, components or steps may be present, utilized or combined with other elements, components or steps not expressly referenced. The technical and scientific terms used herein have the same meaning as commonly understood by unless defined otherwise.

As used herein, the term "hydroprocessing" refers to any methodology capable of treating and/or refining one or more hydrocarbon fractions, including "pre-treatment" methods, such that one or more non-commercial hydrocarbon precursors and/or commercial hydrocarbon products, including but not limited to naphtha, fuels, lubricants, commodity chemicals and combinations thereof, are ultimately produced. In some embodiments, hydroprocessing includes but is not limited to hydrocracking including mild hydrocracking, moderate pressure and/or temperature hydrocracking and full conversion hydrocracking, vacuum gas oil hydrocracking, diesel hydrocracking and hydrotreating. In certain embodiments, hydroprocessing is performed using one or more hydroprocessing catalysts, alternatively referred to as hydroconversion catalysts or hydrotreating catalysts. Examples of these catalysts include but are not limited to silica, silica-alumina, zeolites, and transition metals such as molybdenum, nickel and cobalt that are optionally supported by silica, silica-alumina and/or zeolites. In accordance with the present invention, a hydroprocessing catalyst may optionally be supported by a catalyst bed.

The term "aromatics", alternatively referred to as "aromatic hydrocarbons", "aromatic chemicals", "aromatic compounds" and "arenes", refer to organic (carbon based) chemicals or compounds characterized by delocalized pi ($\pi$) electron density as opposed to discrete alternating bonds such as alternating single and double bonds. In accordance with the present invention, aromatics include chemicals or compounds such as homocyclics comprising an equal number of carbon and hydrogen atoms ($C_nH_n$) including but not limited to benzene; heterocyclics comprising heteroatoms such as sulfur, nitrogen and oxygen and heteroarenes; polycyclics including but not limited to naphthalene, anthracene and phenanthrene; and substituted aromatics including but not limited to toluene and xylenes.

Figure 1:
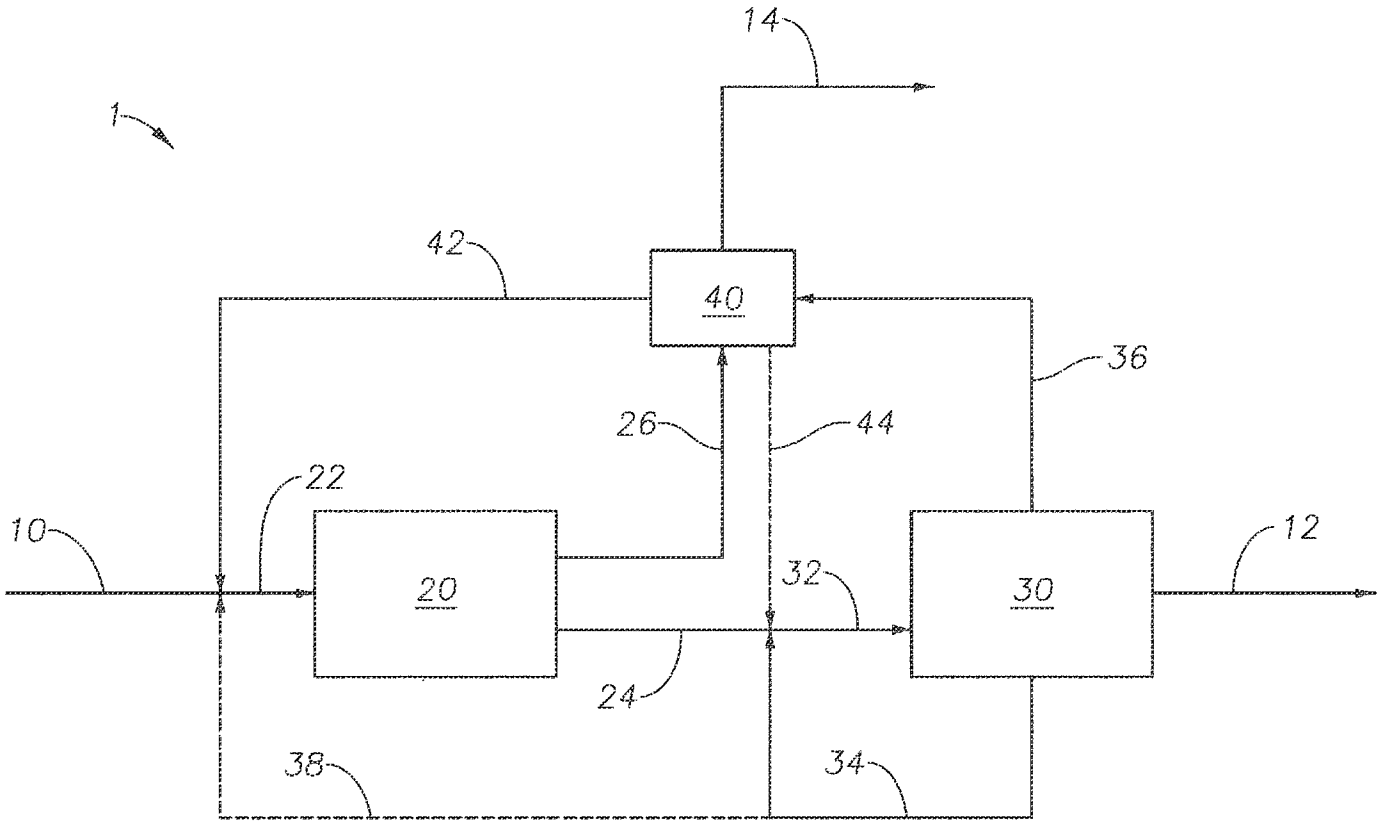
FIG. 1 shows a general process flow diagram for an embodiment of the aromatics production system.

The aromatic chemical production method and system of the present invention uses a wide-boiling temperature range hydrocarbon feedstock to form aromatic products such as BTEX chemicals. The method includes the step of introducing a wide-boiling temperature range hydrocarbon feedstock into the aromatics production system. Referring to FIG. 1, the wide-boiling temperature range hydrocarbon feedstock is introduced into the aromatics production system 1 through a hydrocarbon feedstock feed line 10 from a wide-boiling temperature range hydrocarbon feedstock source upstream from the systems and outside of the process. The method includes the step of introducing a hydrogen stream or atmosphere into the aromatics production system 1. A make-up hydrogen feed line 12 introduces hydrogen gas into the aromatics production system 1 to maintain a hydrogen atmosphere in the hydrotreating/hydrocracking portion of the process. The aromatics production system 1, in preferred embodiments, produces useful chemical products for downstream petrochemical processing.

The method includes the step of passing an aromatics-rich system product stream comprising benzene, toluene and the xylenes from the aromatics production system 1. The aromatics production system 1 passes an aromatics product stream 14 that optionally comprises a single chemical stream or several combined chemical streams containing mixed or partially-refined benzene, toluene, xylenes (alternatively referred to as mixed xylenes), and combinations thereof, with total aromatics present in the aromatics product stream in a range of about 30% by weight to about 95% by weight. In some embodiments, the aromatics product stream 14 comprises benzene in a range of about 2% by weight to about 30% by weight, toluene in a range of about 10% by weight to about 40% by weight and mixed xylenes in a range of about 8% by weight to about 30% by weight, with para-xylene present in a range of about 1.5% by weight to about 9% by weight. The aromatics production system 1 also passes a liquefied petroleum gas (LPG) stream 16. The LPG stream 16 is effluent from a hydrogen separation and refining process and contains light alkanes, such as those in the methyl ($C_1$) to butyl ($C_4$) hydrocarbon range, and a reduced amount of hydrogen. The mixed hydrogen-poor gases of the LPG stream 16 are useful for additional refining (for example, in hydrogen extraction) and as a high BTU boiler feed for steam and electricity generation outside of the aromatics production system 1.

The wide-boiling temperature range hydrocarbon feedstock is introduced into a hydroprocessing reactor 20 using the hydrocarbon feedstock feed line 10. The combined hydrogen fraction is introduced into the hydroprocessing reactor 20 using a combined hydrogen feed line 22. As shown in FIG. 1, two hydrogen-bearing streams combine to form the contents conveyed by the combined hydrogen feed line 22: hydrogen through the make-up hydrogen feed line 12 and high-purity hydrogen through a refined hydrogen recycle line 52. The refined hydrogen recycle line 52 couples a hydrogen extraction unit 50 to the hydroprocessing reactor 20 and conveys high-purity hydrogen from the hydrogen extraction unit 50 to the hydroprocessing reactor 20. The aromatics production system 1 operates such that the volume ratio of the combined hydrogen to the wide-boiling temperature range hydrocarbon feedstock introduced into the hydroprocessing reactor is in a range of from about 0.1 to about 10. The hydrogen feedstock, alternatively referred to as the hydrogen fraction, comprises "make-up" hydrogen as well as recycled high-purity hydrogen. In alternative embodiments, the hydrogen extraction unit 50 further comprises a solvent extraction system that may be coupled to the aromatization reactor system 40.

The hydroprocessing reactor 20 couples to a hydrocracking product splitter 30 using a hydroprocessing product line 24. The hydroprocessing product line 24 conveys the hydroprocessing product mixture from the hydroprocessing reactor 20 to a hydrocracking product splitter 30. In further embodiments, the hydroprocessing reactor 20 may be coupled to a pressure swing adsorption (PSA) unit 60 for conveying hydrocarbon streams such as naphtha boiling temperature range liquid products using an optional feed line 62 to the aromatization reactor system 40. The hydroprocessing reactor 20 may be further coupled to the pressure swing adsorption (PSA) unit 60 for conveying hydrogen gas and light hydrocarbon gases using an optional feed line 72. The hydrogen gas or light hydrocarbon gases may be returned to the hydroprocessing reactor 20 from the pressure swing adsorption (PSA) unit 60 using an optional feed line 82.

Although shown as independent or combined feed streams, each of the hydrocarbon feedstock feed line 10, the make-up hydrogen feed line 12 and the refined hydrogen recycle line 52 can optionally feed directly into the hydroprocessing reactor 20 without pre-combining or can be introduced into one another as combined feed streams.

In the hydroprocessing reactor 20, the wide-boiling temperature range hydrocarbon feedstock and hydrogen contact at least one hydroprocessing catalyst bed containing a hydroprocessing catalyst. Hydroprocessing catalysts for use in the present invention include those described in U.S. Pat. Nos. 5,993,643; 6,515,032; and 7,462,276; all of which are incorporated herein by reference.

The present invention further includes the step of operating an aromatics production system such that the wide-boiling temperature range hydrocarbon feedstock and hydrogen may be converted into a hydroprocessing product mixture comprising a naphtha boiling temperature range liquid product. The mixture of feedstocks contacts the hydroprocessing catalyst within the hydroprocessing catalyst bed under hydroprocessing conditions such that several reactions may occur simultaneously. The hydroprocessing conditions of the present invention allow the hydrocracking reactor to operate the hydroprocessing catalyst in a hydrogen atmosphere to remove organic sulfur, nitrogen and metal compounds as well as form gases such as hydrogen sulfide and ammonia. The hydroprocessing reactor also operates at a hydrocracking severity such that paraffins, naphthenes and aromatics that are introduced into the system and that exhibit a true boiling point (TBP) temperature greater than about 220° C. are advantageously cracked and saturated into paraffins having a TBP temperature within the naphtha boiling temperature range, which is from about 30° C. to about 220° C. The product composition does not have any hydrocarbon components that have a TBP temperature greater than the highest temperature in the naphtha boiling range (about 233° C.). This TBP temperature reduction also helps to ensure that the product composition of the hydroprocessing reactor is mostly paraffinic in nature; however, the product may optionally contain significant amounts of aromatics and/or naphthenes. In some embodiments, the temperature within the hydroprocessing reactor of the aromatics production system is maintained in a range of from about 200° C. to about 600° C. In further embodiments, the pressure within the hydroprocessing reactor of the aromatics production system is maintained in a range of from about 5 bars to about 200 bars. In certain embodiments, the liquid hourly space velocity (LHSV) within the hydroprocessing reactor of the aromatics production system is maintained in a range of from about 0.1 hours$^{-1}$ to about 20 hours$^{-1}$.

In preferred embodiments, the aromatics production system forms the hydroprocessing product mixture under hydroprocessing reactor operating conditions within the hydroprocessing reactor from the combination and conversion of wide-boiling temperature range hydrocarbon feedstock and hydrogen. The hydroprocessing mixture is a combination of liquids and gases comprising a light product gas mixture, a naphtha boiling temperature range liquid product and an unconverted, hydrotreated and partially-hydrocracked hydrocarbon fraction. In some embodiments, the aromatics production system operates such that the first-pass conversion rate of the wide-boiling temperature range hydrocarbon feedstock into the naphtha boiling temperature range liquid product is in a range of from about 15% to about 75% of the introduced wide boiling range condensate.

The aromatics production system 1 is operable to pass the hydroprocessing product mixture from the hydroprocessing reactor 20 into a hydrocracking product splitter 30 using the hydroprocessing product line 24. A light products stream 34 couples the hydrocracking product splitter 30 to a hydrogen extraction unit 50. The hydrocracking product splitter 30 also couples to an aromatization reactor system 40 using a naphtha feed stream 36.

The present invention includes the operation of the aromatics production system such that the hydroprocessing product mixture is selectively separated into liquid and gas fractions, wherein the gas fraction is the light product gas mixture and the liquid fraction includes the naphtha boiling temperature range liquid product. The light product gas mixture is predominantly a mixture of hydrogen and light alkanes in the methyl ($C_1$) to pentyl ($C_5$) hydrocarbon range, and may contain reduced amounts of hydrogen sulfide, ammonia and water vapor as compared to an unprocessed mixture. In some embodiments, the aromatics production system operates such that the light product gas mixture comprises hydrogen in a range of from greater than about 0.1 wt. % to about 50 wt. % of the light product gas mixture. The aromatics production system 1 is operable to pass the light product gas mixture from the hydrocracking product splitter 30 and introduce it to the hydrogen extraction unit 50 using the light products stream 34. The light product gas mixture may comprise about 1% by weight to about 15% by weight of the total hydroprocessing product mixture.

The method further includes the step of selectively separating the naphtha boiling temperature range liquid product and the unconverted, hydrotreated and partially-hydrocracked hydrocarbon product using the aromatics production system. The naphtha boiling temperature range liquid product consists of materials having TBP temperatures no greater than about 220° C. that are separated in the hydrocracking product splitter from the unconverted hydrotreated and partially-hydrocracked hydrocarbons, which have materials with TBP temperatures greater than the maximal TBP temperature (about 233° C.) of the naphtha boiling temperature range liquid product. The naphtha boiling temperature range liquid product and the unconverted, hydrotreated and partially-hydrocracked hydrocarbon product may be separated using traditional distillation methods known to the skilled artisan, as well as packed columns such as packed capillary columns, fractionation and separation trays and combinations thereof. In certain embodiments, the naphtha boiling temperature range liquid product has a high TBP temperature in a range of from about 150° C. to about 220° C. In such embodiments, the unconverted hydrotreated and partially-hydrocracked hydrocarbons, which comprise the remainder of the liquid, have TBP temperatures greater than the high TBP temperature of the naphtha boiling temperature range liquid product up to about 233° C. In some embodiments, the total amount of naphtha boiling temperature liquid product versus hydroprocessing product mixture is in a range of about 5% by weight to about 90% by weight. In certain embodiments, the total amount of unconverted hydrotreated and partially-hydrocracked hydrocarbons versus hydroprocessing product mixture is in a range of about 0.1% by weight to about 95% by weight. In further embodiments, the aromatics production system operates such that about 0.1% by weight to about 49% by weight of the hydroprocessing product mixture is recycled back to the hydroprocessing reactor.

In further embodiments, the method includes the step of operating the aromatics production system such that the naphtha boiling temperature range liquid product is converted into an aromatics-rich system product comprising benzene, toluene and mixed xylenes. FIG. 1 shows the aromatics production system 1 operable to introduce the naphtha boiling temperature range liquid product into the aromatization reactor system 40 using the naphtha feed stream 36. The aromatics product stream 14 conveys the aromatics-rich system product, which includes benzene, toluene and the xylenes, downstream for additional processing and separations outside of the aromatics production system 1, including petrochemical processing. The light products stream 42 is operable to convey hydrogen-rich gas product from the aromatization reactor system 40 to the hydrogen extraction unit 50 for hydrogen recovery and recycle.

In further embodiments, the aromatics production system may be operated such that high-purity hydrogen from the hydrogen extraction unit is introduced. FIG. 1 shows a dashed high-purity hydrogen feed line 54 depicting this optional flow path. In some embodiments, the volume ratio of the high-purity hydrogen to the naphtha boiling temperature range liquid product is maintained in a range of from about 0.01 to about 10. Although shown as separately introduced streams, the feed streams may be introduced separately or combined in the system.

In the aromatization reactor system, the naphtha boiling temperature range liquid product contacts at least one aromatization catalyst bed containing an aromatization catalyst. The catalyst bed can be a moving bed or fixed bed reactor. Useful aromatization catalysts include any selective naphtha reforming catalyst, including those described in WIPO Pat. App. Pub. No. WO 1998/036037 A1.

The feed streams may be introduced and contact the aromatization catalyst under conditions such that several reactions may occur simultaneously. The aromatization reactor system is operable under conditions capable of converting the naphtha boiling temperature range liquid product into aromatic products within the hexyl ($C_6$) to octyl ($C_8$) hydrocarbon range as well as a hydrogen-rich gas product. In some embodiments, the aromatics production system is operated such that the temperature within the aromatization reactor system is maintained in a range of from about 200° C. to about 600° C. In certain embodiments, the aromatics production system is operated such that the pressure within the aromatization reactor system is maintained in a range of from about 5 bars to about 200 bars. In further embodiments, the aromatics production system is operated such that the liquid hourly space velocity (LHSV) within the aromatization reactor system is maintained in a range of from about 0.1 hours$^{-1}$ to about 20 hours$^{-1}$.

In preferred embodiments, the aromatics production system is operated such that the conversion rate of the wide-boiling temperature range hydrocarbon feedstock into the aromatics-rich system product is in a range of from about 50% to about 90% of the introduced wide-boiling temperature range hydrocarbon feedstock. In certain embodiments, the aromatics-rich system product comprises at least 30% by weight to about 75% by weight aromatics in the hexyl ($C_6$) to octyl ($C_8$) range. In some embodiments, the aromatics-rich system product comprises at least 80% by weight aromatics in the hexyl ($C_6$) to octyl ($C_8$) range. In further embodiments, the aromatics-rich system product comprises at least 90% by weight aromatics in the hexyl ($C_6$) to octyl ($C_8$) range. In still further embodiments, the aromatics-rich system product comprises at least 95% by weight aromatics in the hexyl ($C_6$) to octyl ($C_8$) range.

The aromatics-rich system product has less than a detectable amount of paraffins, naphthalenes and olefins. In some embodiments, the aromatics production system is operated such that the aromatics-rich system product comprises benzene in a range of about 2% by weight to about 30% by weight of the aromatics-rich system product. In further embodiments, the aromatics production system is operated such that the aromatics-rich system product comprises toluene in a range of from about 10% by weight to about 40% by weight of the aromatics-rich system product. In still further embodiments, the aromatics production system is operated such that the aromatics-rich system product comprises the xylenes in a range of from about 8% by weight to about 30% by weight of the aromatics-rich system product.

FIG. 1 shows the aromatics production system 1 operable to convey to the hydrogen extraction unit 50 both the light product gas mixture from the hydrocracking product splitter 30 using the light products gas stream 34 and the hydrogen-rich gas product from the aromatization reactor system 40 using light products stream 36. Both the light products gas stream 34 and the light products stream 42 provide hydrogen and light alkanes that are selectively separated in the hydrogen extraction unit 50. Alternatively, the light product gas mixture and light products stream may be pre-combined and introduced into the hydrogen extraction unit 50.

The hydrogen extraction unit 50 is operable such that the aromatics production system can selectively separate hydrogen from the introduced gas mixtures and form two products: high-purity hydrogen and a mixed hydrogen-poor gas. Examples of useful hydrogen extraction units include pressure-swing adsorption (PSA) systems, extractive distillation systems, solvent extractions membrane separators and combinations thereof. The configuration of the hydrogen extraction unit reflects the volume of the introduced mixed gas streams as well as the volume and purity of the produced hydrogen for reintroduction. In some embodiments, the aromatics production system is operated such that the high-purity hydrogen produced from the introduced mixed gas is in a range of from about 70% by weight to about 99% by weight of the introduced mixed gas.

FIG. 1 shows the aromatics production system 1 passing the high-purity hydrogen to the hydroprocessing reactor 20 using a refined hydrogen recycle line 52. Optionally, high-purity hydrogen is supplied to aromatization reactor system 40 to facilitate the aromatization reactions. The LPG stream 14 passes the mixed hydrogen-poor gases from the aromatics production system 1 as a by-product stream. The mixed hydrogen-poor gas may be distributed as an LPG fuel or for internal plant combustion and power generation to off-set steam and/or electrical demand. The aromatics production system is operated such that the mixed hydrogen-poor gas comprises no less than about 50% by weight of hydrocarbons in the methyl ($C_1$) to pentyl ($C_5$) range.

An example of a wide-boiling temperature range hydrocarbon feedstock includes wide boiling range condensates, including the two useful wide-boiling range condensates of Middle Eastern origin shown in Table 1. Natural gas wells, especially "tight gas" formations, may produce wide boiling range condensate hydrocarbons that are useful as feedstocks for the present invention. The wide boiling range condensate can originate from natural hydrocarbon-bearing sources such as natural gas reservoirs, light condensate reservoirs, natural gas liquids, shale gas and other gas reservoirs or liquid hydrocarbon-bearing reservoirs that produce a light petroleum liquid in the propyl ($C_3$) to dodecyl ($C_{12}$) range.

Another example of a wide-boiling temperature range hydrocarbon feedstock includes "super light" crude oils, including the Middle Eastern Arabian Super Light (ASL) crude oil described in Table 2, which exhibits an API gravity value in a range of about 39.5 to about 51.1. In accordance with the present invention, a super light crude oil may originate from natural hydrocarbon-bearing sources or from synthetic sources.

The wide-boiling temperature range condensates contain sulfur-bearing heterorganic compounds in a range of from about 200 ppm to about 600 ppm on a sulfur-weight basis. Super light crude oils contain sulfur-bearing heterorganic compounds in a range of from about 100 ppm to about 300 ppm on a sulfur-weight basis. Such sulfur-bearing heterorganic compounds include hydrogen sulfide and aliphatic mercaptans, sulfides and disulfides. In preferred embodiments, the present invention advantageously reduces sulfur levels attributable to sulfur-bearing heterorganic compounds and elemental sulfur in the wide-boiling temperature range condensates. The compounds may be converted into hydrogen sulfide and evolved from or collected in the hydroprocessing reactor.

The wide-boiling temperature range hydrocarbon feedstocks may contain metal-bearing heterorganic compounds, including but not limited to transition metals such as vanadium, nickel, cobalt and iron, and alkali or alkaline earth metal salts included but not limited to sodium, calcium and magnesium. Transition metals such as vanadium are capable of poisoning hydroprocessing catalysts. The total metals are typically limited in the wide boiling range condensates to no more than about 50 parts per million on a metal-hydrocarbon feedstock basis. Total metals are limited in the super-light crude oil to no more than about 60 parts per million on a metal-hydrocarbon feedstock basis.

The wide-boiling temperature range hydrocarbon feedstock also contains smaller quantities of nitrogen-bearing compounds, including pyridines, quinolones, isoquinolines, acridines, pyrroles, indoles and carbazoles. In accordance with the present invention, nitrogen levels are a measure of total pyridines, quinolones, isoquinolines and acridines, as well as nitrogen containing salts such as nitrates, and are limited in the wide boiling range condensates to no more than about 600 parts per million (ppm) on a nitrogen-weight basis. Total nitrogen levels are limited in the super-light crude oil to no more than about 350 ppm on a metal-hydrocarbon feedstock basis.

The wide boiling range condensates comprise substantial amounts of paraffins, naphthenes and aromatics while typically having less than a detectable amount of olefins. In some embodiments, the wide boiling range condensate comprises paraffins in a range of from about 60% by weight to about 100% by weight of the wide boiling range condensate. In further embodiments, the wide boiling range condensate comprises naphthenes in a range of from about 60% by weight to about 100% by weight of the wide boiling range condensate. In still further embodiments, the wide boiling range condensate comprises aromatics in a range of from about 0.1% by weight to about 40% by weight of the wide boiling range condensate. The super light crude oils comprise similar amounts of paraffins, naphthenes and aromatics while likewise having less than a detectable amount of olefins.

Useful wide boiling range condensates include a substantial portion of the condensate that has a true boiling point (TBP) distillation temperature within the naphtha boiling temperature range. As shown in Table 1, both condensates have about 30% by weight of the total material having a TBP temperature greater than about 233° C. The portion of the condensate with a TBP temperature greater than about 233° C. is gas oil-boiling point temperature range material, which may be used to produce diesel fuel. In an embodiment of the method, a portion of the wide boiling range condensate has a true boiling point (TBP) temperature greater than 233° C. In a further embodiment of the method, the portion having the TBP temperature greater than 233° C. comprises up to about 75% by weight of the introduced wide boiling range condensate. In some embodiments, the wide boiling range condensate has a final boiling point (FBP) temperature in a range of from about 400° C. to about 565° C.

Table 2 shows data derived from a super light crude oil that comprises a substantial chemical portion having a true boiling point (TBP) distillation temperature within the naphtha boiling temperature range, as both condensates have about 35% by weight of the total material having a TBP temperature greater than about 212° C. The portion of the super light crude oil with a TBP temperature greater than about 212° C. is gas oil and fuel oil boiling point temperature range material, which may be converted into diesel and heavy fuel oils. In some embodiments, a portion of the super light crude oil has a true boiling point (TBP) temperature greater than 212° C. In further embodiments, the portion having the TBP temperature greater than 212° C. comprises up to about 50% by weight of the introduced super light crude oil. In certain embodiments, the super light crude oil has a final boiling point (FBP) temperature in a range of from about 600° C. to about 900° C., preferably in a range of from about 700° C. to about 800° C.

The wide-boiling temperature range hydrocarbon feedstock has a portion of material that has a TBP temperature of less than about 25° C. For the two wide boiling range condensates of Table 1, the portion of material that has a TBP temperature of less than about 25° C. comprises about 5% by weight of the total material, while the super light crude oil of Table 2 comprises about 3% by weight to 6% by weight of the total material. This fraction of the wide-boiling temperature range hydrocarbon feedstock may be collected as LPG and/or hydrogen gas for supporting hydroprocessing. In some embodiments, a portion of the wide-boiling temperature range hydrocarbon feedstock has a true boiling point (TBP) temperature of less than about 25° C. In further embodiments, the portion comprises up to about 20% by weight of the feedstock.

TABLE 1

Two examples of useful Middle Eastern-originating wide boiling range condensates

| Hydrocarbon Stream | Natural Gas Condensate No. 1 | Natural Gas Condensate No. 2 |
|---|---|---|
| Sulfur (ppm) | 271 | 521 |
| Metals (ppb) | | |
| V | <20 | <20 |
| Ni | <20 | <20 |
| Fe | <20 | <20 |
| Cu | <20 | 395 |
| Na | 50 | 110 |
| Hg | — | <1 |
| As | — | <1 |
| Basic Nitrogen (ppm) | <10 | <10 |

TABLE 1-continued

Two examples of useful Middle Eastern-originating wide boiling range condensates

| PIONA Analysis | | |
|---|---|---|
| Paraffins (wt. %) | 63.9 | 63.2 |
| Olefins (wt. %) | 0 | 0 |
| Naphthenes (wt. %) | 21.3 | 21.7 |
| Aromatics (wt. %) | 14.8 | 15.1 |
| **True Boiling Point (TBP) Analysis** | | |
| wt. % of Total Material | ° C. | ° C. |
| 5 | 24 | 25 |
| 10 | 57 | 63 |
| 20 | 91 | 94 |
| 30 | 112 | 112 |
| 40 | 138 | 139 |
| 50 | 163 | 164 |
| 60 | 195 | 196 |
| 70 | 233 | 233 |
| 80 | 273 | 271 |
| 90 | 342 | 339 |
| Final Boiling Point (FBP) Temperature | 478 | 482 |

TABLE 2

Examples of a useful Middle Eastern-originating "super light" crude oil

| | True Boiling Range | | | | | | | | | |
|---|---|---|---|---|---|---|---|---|---|---|
| | C4 Lights | C5 - 200° F. | 200° F.-315° F. | 315° F.-400° F. | 400° F.-500° F. | 500° F.-600° F. | 600° F.-700° F. | 700° F.-800° F. | 800° F.-900° F. | 900° F.-1050° F. |
| Yield Weight (%) | 3.1 | 12.1 | 20.6 | 13.0 | 14.3 | 11.4 | 9.5 | 6.0 | — | — |
| Yield Volume (%) | 4.2 | 13.9 | 21.6 | 12.9 | 13.8 | 10.8 | 8.7 | 5.4 | — | — |
| Sulfur (wt. %) | — | 0.0009 | 0.0012 | 0.0016 | 0.0074 | 0.0157 | 0.0630 | 0.1022 | — | — |
| Nickel (ppm) | — | — | — | — | — | — | <1 | <1 | — | — |
| Nitrogen (ppm) | — | — | — | — | — | — | 10 | 96 | — | — |
| **PIONA Analysis** | | | | | | | | | | |
| Paraffins Volume (%) | — | 84.18 | 68.60 | 53.00 | — | — | — | — | — | — |
| Olefins Volume (%) | — | — | — | — | — | — | — | — | — | — |
| Naphthenes Volume (%) | — | 15.30 | 25.05 | 16.30 | — | — | — | — | — | — |
| Aromatics Volume (%) | — | 0.52 | 6.36 | 30.70 | — | — | — | — | — | — |
| **TBP Analysis (° F.)** | | | | | | | | | | |
| Initial Boiling Point (° F.) | — | 85 | 153 | 258 | 344 | 472 | 553 | — | — | — |
| 5% Recovered (° F.) | — | 93 | 192 | 294 | 383 | 501 | 591 | — | — | — |
| 10% Recovered (° F.) | — | 95 | 207 | 305 | 397 | 512 | 603 | — | — | — |
| 20% Recovered (° F.) | — | 98 | 217 | 324 | 419 | 525 | 618 | — | — | — |
| 30% Recovered (° F.) | — | 131 | 231 | 334 | 427 | 540 | 630 | — | — | — |
| 40% Recovered (° F.) | — | 139 | 244 | 345 | 441 | 552 | 639 | — | — | — |
| 50% Recovered (° F.) | — | 154 | 254 | 348 | 453 | 565 | 651 | — | — | — |
| 60% Recovered (° F.) | — | 157 | 261 | 359 | 461 | 577 | 660 | — | — | — |
| 70% Recovered (° F.) | — | 167 | 277 | 370 | 477 | 583 | 673 | — | — | — |
| 80% Recovered (° F.) | — | 189 | 290 | 384 | 489 | 593 | 683 | — | — | — |
| 90% Recovered (° F.) | — | 200 | 305 | 392 | 506 | 604 | 697 | — | — | — |
| 95% Recovered (° F.) | — | 210 | 316 | 403 | 520 | 608 | 705 | — | — | — |
| End-Point (° F.) | — | 219 | 335 | 420 | 569 | 626 | 725 | — | — | — |

The wide boiling range condensates of Table 1 and the super light crude oil of Table 2 are good wide-boiling temperature range hydrocarbon feedstocks for a catalytic naphtha reforming process, including aromatization, once certain issues are addressed prior to their introduction into the aromatization process. For instance, the removal of the heterorganic sulfur and metal compounds in the feedstocks beneficially preserves the quality of the reforming catalyst. In addition, hydrocracking of the high-boiling point materials of these feedstocks into lighter, naphtha boiling temperature range liquids makes the processing of the resulting hydrocarbon liquids less energy intensive and reduces the necessity for supplemental hydrogen. The removal of the lightest materials in the feedstocks, i.e. the materials that have TBP temperatures less than about 25° C., advantageously reduces the size and volume requirement for the equipment used in catalytic naphtha reforming. The low-temperature boiling materials, which typically include LPG, act as a diluent in the process. These light materials would otherwise require greater amounts of external energy for hydrocracking than hydrocarbons exhibiting greater carbon content. The exclusion of the wide-boiling temperature range hydrocarbon feedstock therefore permits the same hydrocracking operation on greater concentrations of larger carbon content material at lower processing temperatures, which advantageously reduces energy consumption and cost.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

EXAMPLE

The following example is included to demonstrate preferred embodiments of the invention. It should be appreciated by those of skill in the art that the techniques and compositions disclosed in the examples which follow represent techniques and compositions discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or a similar result without departing from the spirit and scope of the invention.

Example 1

In accordance with embodiments of the present invention, a crude conditioner was modelled using the HYSYS Hydroprocessing Model, which may incorporate kinetic processes for both hydrotreating and hydrocracking reactions involving hydrocarbons. The crude conditioner model was calibrated to match crude conditioner pilot plant test data obtained from earlier trials. The crude conditioner model unit may be used to evaluate and predict properties associated with crude oil and natural gas refinement and treatment, including but not limited to Arab Extra Light (AXL) crude oil and Kuff Gas Condensate (KGC) upgrading and improvement.

AXL crude oil, KGC and hydrogen gas were fed to the crude conditioner. The conditioning of the feed streams is performed using a calibrated HYSYS kinetic model. The HYSYS model includes three reactor beds, a high pressure separator, a recycle compressor and a hydrogen recycle loop, ensuring that the calibration takes into account both the reactors and the hydrogen recycle loop as shown in FIG. 2.

Figure 2:
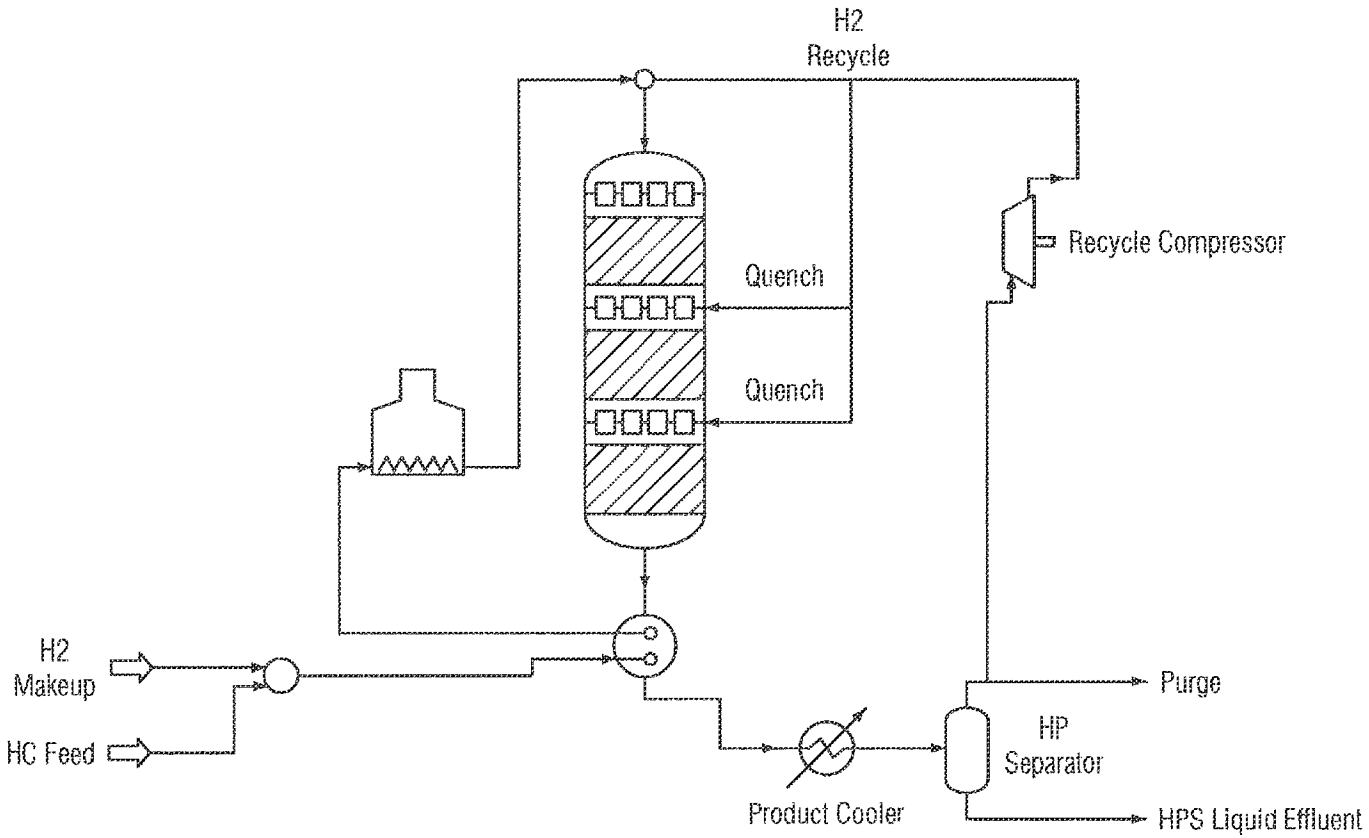
FIG. 2 shows a hydrocarbon processing unit in accordance with some embodiments of the present invention.

As shown in FIG. 2, high pressure separation gas from the high pressure separator and the HPS liquid effluent exit into a main flowsheet, where the liquid from the high pressure separator proceeds to a component splitter comprising a hydrogen sulfide ($H_2S$) absorber and all $H_2S$ as well as hydrogen ($H_2$), ammonia ($NH_3$) and water ($H_2O$) are removed. The resulting liquid hydrocarbon stream is sent to a component splitter where the effluent is separated into hydrogen fractions based on total boiling point (TBP) temperatures for the hydrocarbon stream cut points and the resulting yields are calculated.

In some embodiments, the HYSYS hydroprocessing model described herein uses a set of 142 variables or "pseudocomponents" to characterize one or more feedstocks that may comprise compounds such as hydrogen gas and increase in molecular complexity, for example hydrocarbon compounds containing up to about 50 carbon atoms, including 47 carbon atoms. The "pseudocomponents" components, in certain embodiments, are used to model a series of reaction pathways, alternative referred to as a "reaction network", that may comprise up to about 200 reaction pathways, including a model comprising a series of 177 reaction pathways. The components and reaction network(s) described herein are consistent with hydroprocessing reactions known to those of skill in the art.

The compounds comprising the light gas (C3 (propane) and lighter) were calculated as methane, ethane and propane and related derivatives in the modeling described herein. For hydrocarbon species in the C4 (butane) to C10 (decane) range, one pure component was used to represent several isomers. For example, the properties associated with n-butane were used to represents the properties for both n-butane and iso-butane. For hydrocarbon compounds with a greater number of carbon atoms, compounds with carbon numbers of 14, 18, 26, and 47 were used, as these values were found to represent a wide range of boiling point components in higher (greater than 10 carbon atoms) hydrocarbon compound fractions.

The components used in the hydroprocessing model described herein also comprise different classes of hydrocarbons including monocyclic (one-ring) to tetracyclic (four-ring) carbon species including aromatics and naphthenics. 13 sulfur components were used to represent the sulfur compound distribution in the feed, while 10 basic and non-basic nitrogen components were utilized. The HYSYS hydroprocessing model described herein does not track metals such as transition metal complexes or asphaltenes and thus these compounds were excluded from modeling. The AXL crude oil (Table 3) and KGC (Table 4) assay feed fingerprint results are shown in Tables 3 and 4:

TABLE 3

AXL Crude Oil Assay Results

| AXL Crude Oil Feed TBP Cut Yield | AXL Crude Oil Assay Simulation Result (Weight %) |
|---|---|
| C1-C4 (less than 70° C.) | 3.4% |
| C5 (Naphtha 1; about 70° C.) | 4.3% |
| Naphtha 2 (70° C.-180° C.) | 24.8% |
| Kerosene (180° C.-220° C.) | 8.4% |
| Diesel (220° C.-350° C.) | 24.1% |
| Vacuum Gas Oil (350° C.-540° C.) | 18.4% |
| Heavy Hydrocarbon Residue (>540° C.) | 16.5% |
| **AXL Crude Oil Chemical Species** | **Weight % Per Fraction** |
| Paraffins in C5 (Naphtha 1; about 70° C.) | 94% |
| Naphthenes in C5 (Naphtha 1; about 70° C.) | 5% |

TABLE 3-continued

| AXL Crude Oil Assay Results | |
|---|---|
| Aromatics in C5 (Naphtha 1; about 70° C.) | 1% |
| Paraffins (Naphtha 2; 70° C.-180° C.) | 64% |
| Naphthenes (Naphtha 2; 70° C.-180° C.) | 19% |
| Aromatics (Naphtha 2; 70° C.-180° C.) | 17% |
| Paraffins (Kerosene; 180° C.-220° C.) | 53% |
| Naphthenes (Kerosene; 180° C.-220° C.) | 22% |
| Aromatics (Kerosene; 180° C.-220° C.) | 25% |
| Paraffins (Diesel; 220° C.-350° C.) | 42% |
| Naphthenes (Diesel; 220° C.-350° C.) | 33% |
| Aromatics (Diesel; 220° C.-350° C.) | 26% |
| Paraffins (Vacuum Gas Oil; 350° C.-540° C.) | 34% |
| Naphthenes (Vacuum Gas Oil; 350° C.-540° C.) | 29% |
| Aromatics (Vacuum Gas Oil; 350° C.-540° C.) | 36% |
| Paraffins (Heavy Hydrocarbon Residue; >540° C.) | 13% |
| Naphthenes (Heavy Hydrocarbon Residue; >540° C.) | 24% |
| Aromatics (Heavy Hydrocarbon Residue; >540° C.) | 62% |

TABLE 4

| KGC Assay Results | KGC Assay Simulation Result (Weight %) |
|---|---|
| KGC Feed TBP Cut Yield | |
| C1-C4 (less than 70° C.) | 2.4% |
| C5 (Naphtha 1; about 70° C.) | 10.7% |
| Naphtha 2 (70° C.-180° C.) | 45.7% |
| Kerosene (180° C.-220° C.) | 11.6% |

TABLE 4-continued

| KGC Assay Results | KGC Assay Simulation Result (Weight %) |
|---|---|
| Diesel (220° C.-350° C.) | 22.4% |
| Vacuum Gas Oil (350° C.-540° C.) | 6.5% |
| Heavy Hydrocarbon Residue (>540° C.) | 0.6% |
| KGC Chemical Species | |
| Paraffins in C5 (Naphtha 1; about 70° C.) | 90% |
| Naphthenes in C5 (Naphtha 1; about 70° C.) | 9% |
| Aromatics in C5 (Naphtha 1; about 70° C.) | 1% |
| Paraffins (Naphtha 2; 70° C.-180° C.) | 59% |
| Naphthenes (Naphtha 2; 70° C.-180° C.) | 25% |
| Aromatics (Naphtha 2; 70° C.-180° C.) | 15% |
| Paraffins (Kerosene; 180° C.-220° C.) | 51% |
| Naphthenes (Kerosene; 180° C.-220° C.) | 23% |
| Aromatics (Kerosene; 180° C.-220° C.) | 25% |
| Paraffins (Diesel; 220° C.-350° C.) | 47% |
| Naphthenes (Diesel; 220° C.-350° C.) | 35% |
| Aromatics (Diesel; 220° C.-350° C.) | 18% |
| Paraffins (Vacuum Gas Oil; 350° C.-540° C.) | 42% |
| Naphthenes (Vacuum Gas Oil; 350° C.-540° C.) | 36% |
| Aromatics (Vacuum Gas Oil; 350° C.-540° C.) | 22% |
| Paraffins (Heavy Hydrocarbon Residue; >540° C.) | 13% |
| Naphthenes (Heavy Hydrocarbon Residue; >540° C.) | 15% |
| Aromatics (Heavy Hydrocarbon Residue; >540° C.) | 15% |

The crude conditioner model was used to predict the AXL and KGC assay hydroprocessing results. The comparison between the untreated and hydroprocessed AXL crude oil (Table 5) and KGC (Table 6) results are as follows:

TABLE 5

| Comparison Between Untreated and (CCU) Hydroprocessed AXL Crude Oil Results | AXL Before Processing | AXL after Crude Conditioner Unit After Processing |
|---|---|---|
| Crude Conditioner Operation Conditions | | |
| Liquid Hourly Space Velocity (LHSV; $h^{-1}$) | | 0.5 |
| Temperature | | 390° C. |
| Pressure | | 150 bar |
| $H_2$/Oil Ratio, L/L | | 1200 |
| AXL Feed TBP Cut Yields, Weight % | | |
| $H_2$ Consumption | — | 1.97% |
| $H_2S$ | — | 2.0% |
| $NH_3$ | — | 0.1% |
| C1-C4 (less than 70° C.) | 3.4% | 2.9% |
| C5 (Naphtha 1; about 70° C.) | 4.3% | 4.8% |
| Naphtha 2 (70° C.-180° C.) | 24.8% | 24.1% |
| Kerosene (180° C.-220° C.) | 8.4% | 11.4% |
| Diesel (220° C.-350° C.) | 24.1% | 26.9% |
| Vacuum Gas Oil (350° C.-540° C.) | 18.4% | 18.4% |
| Heavy Hydrocarbon Residue (>540° C.) | 16.5% | 11.5% |
| C5+ Liquid Yield | | 97.1% |
| Feed TBP Cut PNA Fingerprint results | | |
| Paraffins in C5 (Naphtha 1; about 70° C.) | 94 | 88 |
| Naphthenes in C5 (Naphtha 1; about 70° C.) | 5 | 12 |
| Aromatics in C5 (Naphtha 1; about 70° C.) | 1 | 0 |
| C/H ratio | 5.15 | 5.22 |
| Paraffins (Naphtha 2; 70° C.-180° C.) | 64 | 48 |
| Naphthenes (Naphtha 2; 70° C.-180° C.) | 19 | 20 |
| Aromatics (Naphtha 2; 70° C.-180° C.) | 17 | 32 |
| C/H ratio | 5.94 | 7.09 |
| Paraffins (Kerosene; 180° C.-220° C.) | 53 | 38 |
| Naphthenes (Kerosene; 180° C.-220° C.) | 22 | 25 |
| Aromatics (Kerosene; 180° C.-220° C.) | 25 | 37 |
| C/H ratio | 6.47 | 7.49 |

TABLE 5-continued

| Comparison Between Untreated and (CCU) Hydroprocessed AXL Crude Oil Results | AXL Before Processing | AXL after Crude Conditioner Unit After Processing |
|---|---|---|
| Paraffins (Diesel; 220° C.-350° C.) | 42 | 37 |
| Naphthenes (Diesel; 220° C.-350° C.) | 33 | 23 |
| Aromatics (Diesel; 220° C.-350° C.) | 26 | 40 |
| C/H ratio | 6.51 | 7.09 |
| Paraffins (Vacuum Gas Oil; 350° C.-540° C.) | 34 | 20 |
| Naphthenes (Vacuum Gas Oil; 350° C.-540° C.) | 29 | 22 |
| Aromatics (Vacuum Gas Oil; 350° C.-540° C.) | 36 | 58 |
| C/H ratio | 6.80 | 7.34 |
| Paraffins (Heavy Hydrocarbon Residue; >540° C.) | 13 | 57 |
| Naphthenes (Heavy Hydrocarbon Residue; >540° C.) | 24 | 15 |
| Aromatics (Heavy Hydrocarbon Residue; >540° C.) | 62 | 27 |
| C/H ratio | 7.42 | 6.20 |

TABLE 6

| Comparison Between Untreated and (CCU) Hydroprocessed KGC Results | KGC | KGC after Crude Conditioner Unit |
|---|---|---|
| Crude Conditioner Operation Conditions | | |
| Liquid Hourly Space Velocity (LHSV; $h^{-1}$) | | 0.5 |
| Temperature | | 390° C. |
| Pressure | | 150 bar |
| $H_2$/Oil Ratio, L/L | | 1200 |
| TBP Cut Yields, Weight % | | |
| $H_2$ Consumption | — | 1.81% |
| $H_2S$ | — | 1.60% |
| $NH_3$ | — | 0.1% |
| C1-C4 (less than 70° C.) | 2.4% | 2.8% |
| C5 (Naphtha 1; about 70° C.) | 11.8% | 11.1% |
| Naphtha 2 (70° C.-180° C.) | 46.2% | 48.7% |
| Kerosene (180° C.-220° C.) | 9.5% | 9.6% |
| Diesel (220° C.-350° C.) | 22.7% | 22.2% |
| Vacuum Gas Oil (350° C.-540° C.) | 6.6% | 5.1% |
| Heavy Hydrocarbon Residue (>540° C.) | 0.9% | 0.5% |
| C5+ Liquid Yield | | 97.2% |
| Feed TBP Cut PNA Fingerprint results | | |
| Paraffins in C5 (Naphtha 1; about 70° C.) | 90 | 80 |
| Naphthenes in C5 (Naphtha 1; about 70° C.) | 9 | 20 |
| Aromatics in C5 (Naphtha 1; about 70° C.) | 1 | 0 |
| C/H ratio | 5.16 | 5.29 |
| Paraffins (Naphtha 2; 70° C.-180° C.) | 59 | 33 |
| Naphthenes (Naphtha 2; 70° C.-180° C.) | 25 | 23 |
| Aromatics (Naphtha 2; 70° C.-180° C.) | 15 | 43 |
| C/H ratio | 6.00 | 7.64 |
| Paraffins (Kerosene; 180° C.-220° C.) | 51 | 32 |
| Naphthenes (Kerosene; 180° C.-220° C.) | 23 | 2 |
| Aromatics (Kerosene; 180° C.-220° C.) | 25 | 66 |
| C/H ratio | 6.43 | 8.54 |
| Paraffins (Diesel; 220° C.-350° C.) | 47 | 15 |
| Naphthenes (Diesel; 220° C.-350° C.) | 35 | 46 |
| Aromatics (Diesel; 220° C.-350° C.) | 18 | 39 |
| C/H ratio | 6.49 | 7.64 |
| Paraffins (Vacuum Gas Oil; 350° C.-540° C.) | 42 | 1 |
| Naphthenes (Vacuum Gas Oil; 350° C.-540° C.) | 36 | 30 |
| Aromatics (Vacuum Gas Oil; 350° C.-540° C.) | 22 | 69 |
| C/H ratio | 6.42 | 7.62 |
| Paraffins (Heavy Hydrocarbon Residue; >540° C.) | 13 | 20 |
| Naphthenes (Heavy Hydrocarbon Residue; >540° C.) | 15 | 10 |

TABLE 6-continued

| Comparison Between Untreated and (CCU) Hydroprocessed KGC Results | KGC | KGC after Crude Conditioner Unit |
|---|---|---|
| Aromatics (Heavy Hydrocarbon Residue; >540° C.) | 15 | 70 |
| C/H ratio | — | 6.64 |

Tables 7 and 8 show the predicted yield change for a unit processing 100,000 barrels per day (bbl/day) of AXL crude oil processed with or without the crude conditioning unit (CCU):

TABLE 7

| AXL Crude Oil Simulation Results | | |
|---|---|---|
| Product yields, simulated | AXL Assay without CCU [barrel/day] | AXL Assay with CCU [barrel/day] |
| C1-C4 (less than 70° C.) | 5512 | 9911 |
| Naphtha (C5-180)° C. | 31453 | 33617 |
| Kerosene (180° C.-220° C.) | 8405 | 12312 |
| Diesel (220° C.-350° C.) | 23051 | 27295 |
| Vacuum Gas Oil (350° C.-540° C.) | 16912 | 17867 |
| Heavy Hydrocarbon Residue (>540° C.) | 14666 | 9931 |

TABLE 8

| KGC Simulation Results | | |
|---|---|---|
| Product yields, [barrel/day] | KGC Assay w/o CCU [barrel/day] | KGC Assay w/ CCU [barrel/day] |
| C1-C4 (less than 70° C.) | 3185 | 6708 |
| Naphtha (C5-180)° C. | 59040 | 60846 |
| Kerosene (180° C.-220° C.) | 11054 | 8990 |
| Diesel (220° C.-350° C.) | 20571 | 19156 |
| Vacuum Gas Oil (350° C.-540° C.) | 5708 | 4932 |
| Heavy Hydrocarbon Residue (>540° C.) | 441 | 391 |

As shown in Table 8, a significant increase in naphtha yield was observed following the processing of AXL crude oil in the crude conditioner unit. Additionally, the naphtha cuts from 70-220° C. showed an increase in the level of aromatic and naphthenic content as well as a reduction in paraffinic content from AXL crude oil processing. These results indicate both an increase in naphtha yields as compared to normal distillation and in the quality of naphtha produced, including naphtha aromatic species. The increased aromatic content produced in the resulting naphtha streams can, in some embodiments, be advantageously extracted using a benzene-toluene-ethylbenzene-xylenes (BTEX) extraction unit to isolate the valuable aromatics therein.

In addition, an improved diesel and related hydrocarbon fraction was observed. The "diesel cut" produced from AXL crude is beneficially higher in quality as compared to diesel produced, e.g. via crude oil distillation due to the very low to absent sulfur and other contaminants encountered in the distillation route. Similarly, the above referenced "naphtha cut" does not require treatment to remove sulfur and other contaminants as compared to naphtha produced using crude oil distillation.

With regards to KGC hydrocarbon processing, the naphtha yield is also advantageously increased upon processing this feed stream using the crude conditioner (hydroprocessing) unit. The naphtha cuts from 70° C. to 220° C. further exhibited a substantial increase in the level of aromatics produced as well as a reduction in paraffinic content upon hydroprocessing of KGC. The resulting aromatics can be easily extracted from the reactor effluent, in some embodiments, prior to sending naphtha to a catalytic reforming unit for further processing. The increased aromatic content in the naphtha streams can be extracted in an optional BTEX extraction unit, where naphthenic content may easily converted to aromatics in a catalytic naphtha reforming unit. As with AXL crude oil, the processed KGC also produced an improved diesel range yield or "diesel cut yield".

The singular forms "a", "an" and "the" include plural references, unless the context clearly dictates otherwise.

"Optional" or "optionally" means that the subsequently described component may or may not be present or the event or circumstances may or may not occur. The description includes instances where the component is present and instances where it is not present, and instances where the event or circumstance occurs and instances where it does not occur. The verb "couple" and its conjugated forms means to complete any type of required junction, including electrical, mechanical or fluid, to form a singular object from two or more previously non-joined objects. If a first device couples to a second device, the connection can occur either directly or through a common connector. The description includes instances where the event or circumstance occurs and instances where it does not occur. "Operable" and its various forms means fit for its proper functioning and able to be used for its intended use.

Ranges may be expressed herein as from about one particular value, and/or to about another particular value. When such a range is expressed, it is to be understood that another embodiment is from the one particular value and/or to the other particular value, along with all combinations within said range. Where the range of values is described or referenced herein, the interval encompasses each intervening value between the upper limit and the lower limit as well as the upper limit and the lower limit and includes smaller ranges of the interval subject to any specific exclusion provided.

Spatial terms describe the relative position of an object or a group of objects relative to another object or group of objects. The spatial relationships apply along vertical and horizontal axes. Orientation and relational words, including "upstream", "downstream" and other like terms, are for descriptive convenience and are not limiting unless otherwise indicated.

Where a method comprising two or more defined steps is recited or referenced herein, the defined steps can be carried out in any order or simultaneously except where the context excludes that possibility.

Throughout this application, where patents or publications are referenced, the disclosures of these references in their entireties are intended to be incorporated by reference into this application, in order to more fully describe the state of the art to which the invention pertains, except when these references contradict the statements made herein.

What is claimed is:

1. A method for producing hydrocarbon products from a wide boiling range condensate, the method comprising the steps of:

introducing the wide boiling range condensate and hydrogen into a hydroprocessing reactor of an aromatics production system, where a volume ratio of the hydrogen to the wide boiling range condensate introduced is in a range of from about 0.01 to about 10;

operating the aromatics production system under conditions such that the hydroprocessing reactor forms both a light product gas mixture and a naphtha boiling temperature range liquid product, where the naphtha boiling temperature range liquid product consists of naphtha boiling temperature range liquid product components having boiling point temperatures in a range of about 30° C. to about 240° C.;

passing the naphtha boiling temperature range liquid product to an aromatization reactor system and the light product gas mixture passes to a hydrogen extraction unit;

operating the aromatization reactor system under conditions appropriate for forming one or more hydrocarbon products;

passing hydrogen to the hydrogen extraction unit and at least a portion of the non-aromatic liquid product to the aromatization reactor system;

producing hydrogen and a mixed hydrogen-poor gas in the hydrogen extraction unit, wherein the mixed hydrogen-poor gas comprises no less than 70% by weight $C_1$ to $C_5$ alkanes; and passing the hydrogen to the hydroprocessing reactor.

2. The method of claim 1, wherein the hydrocarbon products are selected from the group consisting of aromatic hydrocarbons, petrochemicals, gasolines, kerosene, diesel fuels, liquefied petroleum products, fuel enhancing hydrocarbons, fuel stabilizing hydrocarbons and olefins.

3. The method of claim 1, wherein the hydrogen comprises high-purity hydrogen.

4. The method of claim 1, wherein the aromatization reactor system produces one or more hydrocarbon products selected from an aromatics-rich system product, a hydrogen-rich gas product, a non-aromatic liquid product.

5. The method of claim 4, wherein the non-aromatic liquid product comprises $C_{9+}$ paraffins, naphthenes and monocyclic aromatic compounds.

6. The method of claim 1, wherein the hydroprocessing reactor further comprises a hydroprocessing catalyst.

7. The method of claim 6, wherein the hydroprocessing catalyst is maintained in a hydrogen atmosphere.

8. The method of claim 6, wherein the hydroprocessing catalyst is operable to reduce the concentration of non-hydrocarbon compounds selected from sulfur, nitrogen, transition metals, alkali metals and alkaline earth metals.

9. The method of claim 1, wherein the hydrogen extraction unit further comprises a solvent extraction system.

10. The method of claim 1, wherein a portion of the wide boiling range condensate has a true boiling point (TBP) temperature greater than about 230° C.

11. The method of claim 1, the wide boiling range condensate is converted into the naphtha boiling temperature range liquid product at an initial conversion rate in a range of from about 15% to about 75%.

12. The method of claim 1, wherein the wide boiling range condensate has a final boiling point (FBP) temperature in a range of from about 400° C. to about 600° C.

13. The method of claim 1, wherein the wide boiling range condensate comprises aromatics in a range of about 0.1% by weight to about 40% by weight of the wide boiling range condensate.

14. The method of claim 2, wherein the aromatic hydrocarbons comprise mixed xylenes in a range of from about 8% by weight to about 30% by weight.

* * * * *